United States Patent [19]

Anderson et al.

[11] Patent Number: 4,842,886

[45] Date of Patent: Jun. 27, 1989

[54] METHOD FOR ELECTROLESS PLATING

[75] Inventors: Nathaniel C. Anderson, Pine Island; Marlin E. Miner, Dodge Center, both of Minn.; Lubomyr T. Romankiw, Briarcliff Manor, N.Y.; Steven F. Starcke, Rochester, Minn.

[73] Assignee: International Business Machines Corporation, Armonk, N.Y.

[21] Appl. No.: 117,164

[22] Filed: Nov. 4, 1987

[51] Int. Cl.[4] ..... B05D 1/18

[52] U.S. Cl. ..... 427/10; 427/130; 427/131; 427/437; 428/693; 428/694; 428/900; 428/928

[58] Field of Search ..... 427/10, 130, 131, 437; 428/900, 928, 693, 694

[56] References Cited

U.S. PATENT DOCUMENTS 4,626,446 12/1986 Capwell et al. ..... 127/10 X

*Primary Examiner*—Bernard Pianalto

*Attorney, Agent, or Firm*—Robert W. Lahtinen

[57] ABSTRACT

The mixed potential of a standard reference electrode and an electrically conductive article that is being electrolessly plated is compared to a DC reference voltage. A predetermined level of comparison indicates the start of electroless plating. This comparison starts a timer. After a predetermined time interval has expired, plating is terminated. The result is a plated coating that is uniform and of a closely controlled thickness. The article to be plated is a thin film magnetic recording disk upon which a thin cobalt containing layer, in the range of about 850 angstroms thick, is to be plated.

10 Claims, 4 Drawing Sheets

METHOD FOR ELECTROLESS PLATING

FIELD OF THE INVENTION

This invention relates to the field of electroless plating, and more specifically to a mixed potential method and apparatus for detecting or sensing the start or onset of electroless deposition on an article to be plated. Accurate sensing of the start of deposition is used to subsequently terminate the plating process, thereby producing a plated layer having an accurately controlled thickness. The invention finds utility in plating a cobalt magnetic recording layer during the manufacture of magnetic recording media, such as a rigid magnetic recording disk, for example a thin film disk.

BACKGROUND OF THE INVENTION

The mixed potential chemical phenomenon used in the present invention is well known, and is the electrical potential that is generated or set up by two chemical reactions.

It is also known that the thickness of a magnetic recording layer must be closely controlled. This is due to the fact that the magnetic recording phenomena is dependent upon the thickness of this layer. Forming a magnetic recording layer by the use of a plating process is also known.

Electroless plating is the controlled autocatalytic deposition of a continuous metal film by the interaction of a metal salt and a chemical reducing agent in solution. In this plating process the electrons that are used for reduction are supplied by the bath's chemical reducing agent. As a result, electroless plating solutions are not thermodynamically stable because the reducing agent and the metal salt are always present and ready to react.

After an article to be plated is placed in the plating bath, electroless deposition usually initiates at a later time. The time at which plating onset occurs is variable, and is a function of a number of plating parameters, such as the temperature of the plating bath, the composition of the bath and the characteristics of the surface being plated. While some of these parameters, such as temperature and composition, can be held reasonably constant, the surface characteristics of the article being plated are unpredictable, and have been found to be highly dependent upon prior handling of the article, also known as the prior history of the article.

For example, we have found that the start of electroless plating can occur from zero to 45 seconds after the article to be plated is placed in the plating bath. In an extreme case, plating onset may occur as long as 45 minutes after the article has been placed in the plating bath.

If the plated layer's maximum thickness is not critical, the article can be plated long enough to produce a minimum layer thickness, without regard to how much longer the article is plated. However, this is a costly manufacturing process.

When magnetic recording media is manufactured, the magnetic layer must be plated to a closely controlled thickness.

Due to the inherent properties of the electroless plating process, it is difficult to control the thickness of the plated layer, especially during continuous manufacture involving the sequential plating of a number of articles.

Others have addressed problems of this type. For example, in U.S. Pat. No. 4,556,845 an eddy current probe is subjected to electroless plating along with the article to be plated. As the thickness of an electrically conductive plated layer increases on the probe's sensing surface, the eddy currents flowing in this plated layer increase. This increase in eddy current flow is used as an indirect measure of the thickness of the layer being plated on the article.

U.S. Pat. No. 4,477,484 teaches another means of indirect measurement in an electroless plating process. In this patent, the article to be plated is plated along with a "test coupon" that is structurally very much like the article to be plated. This coupon includes electrical circuit conductors that are separated by an insulating area that will be plated. As plating initiates, the decreasing resistance that is measured across these conductors is used as an indirect measure of the initiation, progression and quality of the electroless plating that is occurring at the article to be plated.

SUMMARY OF THE INVENTION

The present invention provides a method and apparatus for directly determining the onset of electroless plating by use of mixed potential detector means that directly responds to the changing electrical potential associated with the plating solution/plating surface interface, i.e. the potential associated directly with the surface being plated.

A mixed potential is the electrical potential generated by two chemical reactions, in this case (1) the reaction at the interface of the article being plated and the plating bath, and (2) the reaction at the interface of a standard reference electrode and the plating bath.

More specifically, the present invention compares the potential output of a standard reference electrode, for example a silver/silver chloride standard electrode or a calomel standard electrode, with the changing potential at the surface of the article being plated.

The present invention compares this mixed potential to a fixed magnitude reference potential. When the result of this comparison reaches a predetermined value, the start of electroless deposition on the article surface is indicated and a signal is generated. This signal is used, for example, to initiate operation of a timer. The timer terminates the plating process after a predetermined time has expired. As a result, a uniform layer of accurately controlled thickness is plated on an article.

The invention is used to plate a cobalt alloy layer on magnetic recording media in the form of thin film disks. Electroless cobalt plating baths have an initiation time that varies generally between zero and 45 seconds, and can be as long as 45 minutes under unusual conditions. Since the total plating time is about three minutes for the metal thickness required, the bath's variable initiation time represents a large source of variability in the amount of cobalt deposited when using prior art means of plating thin film disks. The present invention solves this problem by detecting the initiation of plating and providing an electrical signal that is used to start a plating process timer. As a result, much tighter control of metal deposition thickness is obtained using the present invention.

THE INVENTION

The present invention will be described as it is used to plate a cobalt alloy layer on thin film magnetic recording disks. However, the invention finds utility in any electroless plating process that demonstrates an inherent time period between immersion of an article in the plating bath and the subsequent start of metal deposit on the article.

In its broadest aspect, the present invention provides a circuit means that detects the mixed potential jump or sudden transition that occurs at the onset of plating. Within the scope of the invention, this jump in potential can be detected by any number of circuit means. Two examples are the use of a voltage level detector and the use of a rate of change or slope detector.

Figure 1:
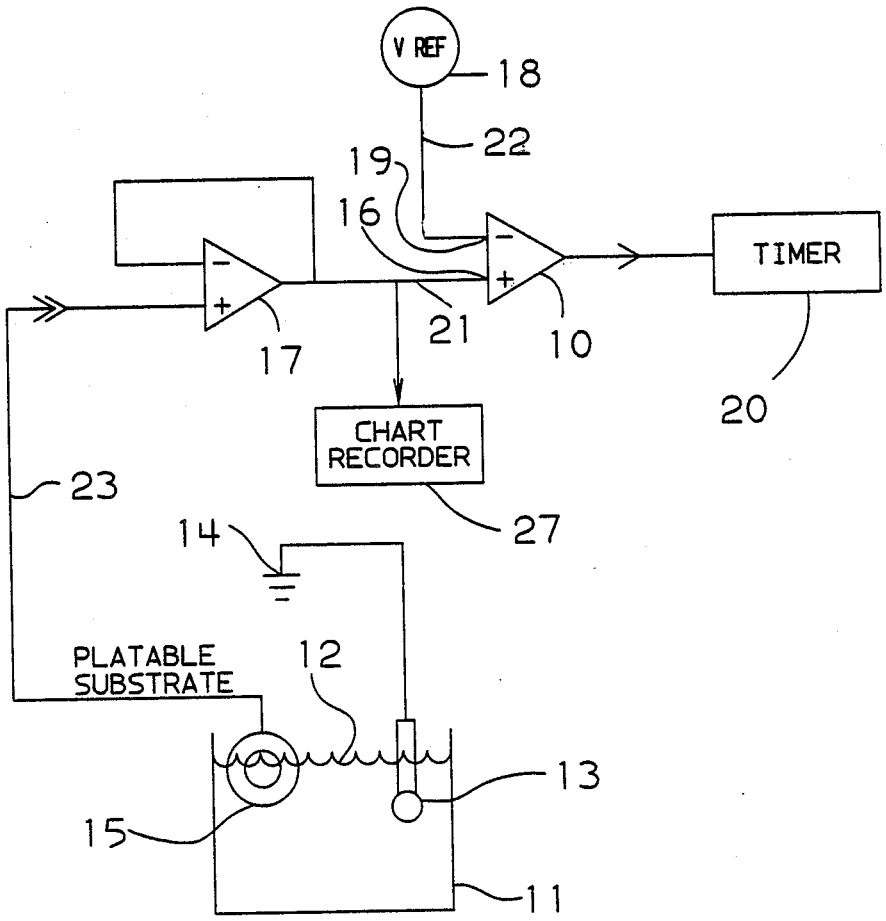
FIG. 1 shows an embodiment of the invention that is based upon voltage level detection.

FIG. 1 shows a first embodiment of the invention wherein the detection circuit means comprises a level detector in the form of voltage comparator circuit 10.

The electroless plating process takes place in a tank 11 having a cobalt electroless plating solution 12 therein. A standard reference electrode 13, for example of the silver/silver chloride type, is suspended in the bath as shown. The standard electrode is connected to ground potential at 14.

If desired, standard electrode 13 can be placed in a separate cobalt plating bath, which bath is then connected to tank 11 by way of a salt bridge. In accordance with the invention, such a salt bridge embodiment is to be considered as placing the standard reference electrode in the same plating bath as the article to be plated.

The article 15 to be plated, for example a rigid magnetic recording disk having a nickel phosphorous layer that is to be plated with a cobalt phosphorous layer to a thickness of about 850 angstroms, is also suspended in bath 12. As shown, article 15 is preferably connected to the input 16 of comparator 10 by way of a high impedance buffer amplifier 17.

While article 15 may take any shape or form within the teaching of this invention, the article must be electrically conductive, or in the alternative electrical circuit means must be provided on the article to facilitate electrical connection of the mixed potential comprising the potential at the article's surface to be plated and the potential of standard reference electrode 13 to the input of comparator 10.

A source of DC reference voltage 18 is connected to the other input 19 of comparator 10. This voltage source is adjustable, and provides on output potential in the millivolt range, for example 600 to 900 millivolts.

The output of comparator 10 is connected to timer means 20. Timer means 20 may take a number of different forms, the only requirement being that upon comparator 10 detecting a predetermined voltage level on conductor 21 relative to conductor 22, timer means 20 starts, to indicate that plating on the surface of article 15 has begun.

Timer means 20 is used to terminate plating on the surface of article 15, for example by removing the article from the plating bath. This can be done manually or automatically, by the use of means not shown.

Figure 2:
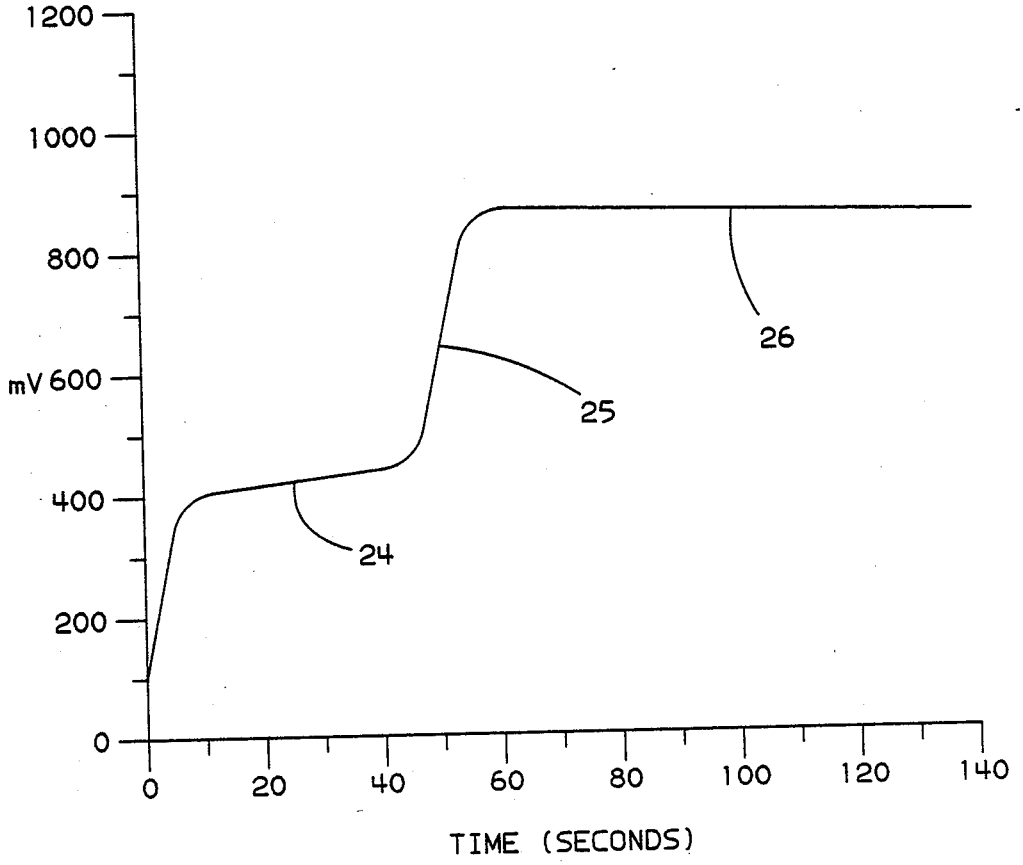
FIG. 2 shows an exemplary mixed potential curve of the type that results from use of the invention.

FIG. 2 is a graph showing an exemplary variation in the above mentioned mixed potential (i.e. the potential on conductor 23 of FIG. 1) as a function of the time that has expired after placing article 15 in bath 12. This potential/time function can take a number of different forms. However, we have observed that all curves are of the general type shown in FIG. 2 in that they all have a sudden jump or transition portion 25, followed by a high magnitude portion 26, indicating that plating has begun.

In this representative curve of mixed potential, it is seen that the potential initially climbs rapidly to a level 24 of, for example, about 400 millivolts. While a chemical reaction is at this time occurring on the surface of article 15, plating has not as yet begun. After the expiration of, for example, 40 seconds, however, the mixed potential curve suddenly jumps, as shown at 25, to about 800 millivolts, as shown at portion 26. This high level 26 of mixed potential is compared to reference potential 18 (FIG.1), and the output of comparator 10 now becomes operative to start timer means 20.

In practice, the potential level of source 18 is set by the following exemplary method. An article 15 is placed in bath 12, and a chart recorder 27 is connected to the output of buffer amplifier 17. The output of the chart recorder provides a curve similar to FIG. 2, and the observed potential level 26 at which plating began is used to set the magnitude of source 18. More specifically, the magnitude of source 18 is set to be at about the middle of potential jump 25.

After the magnitude of source 18 has been set, a number of articles 15 are plated using different time intervals for plating (i.e. different time intervals as measured from the detection of the mixed potential portion 25–26 relative to the set magnitude of source 18). The resulting different thicknesses of the plated metal layer are measured. Since it is known that the plating process is quite linear, timer means 20 is set to give a plating time that will provide the desired plating thickness, for example 850 angstroms.

We have found that the time interval of actual plating (for example 3 minutes), in order to repeatably achieve a desired plating thickness (for example 850 angstroms of cobalt) is not variable. However, the time interval that expires between immersion of article 15 into bath 12 and the subsequent onset of plating is very unpredictable, and appears to be mainly dependent upon the prior history (i.e. handling, storage, etc.) of each individual article. The present invention provides a method and apparatus that eliminates the uncertainty associated with this initial time interval of unpredictable duration.

We have also observed that the magnitude of source 18 will have to be changed as the type of plating bath is changed. However, there is no need to change the magnitude of source 18 when changing, for example, from one cobalt electroless bath to another bath of the same composition.

Figure 3:
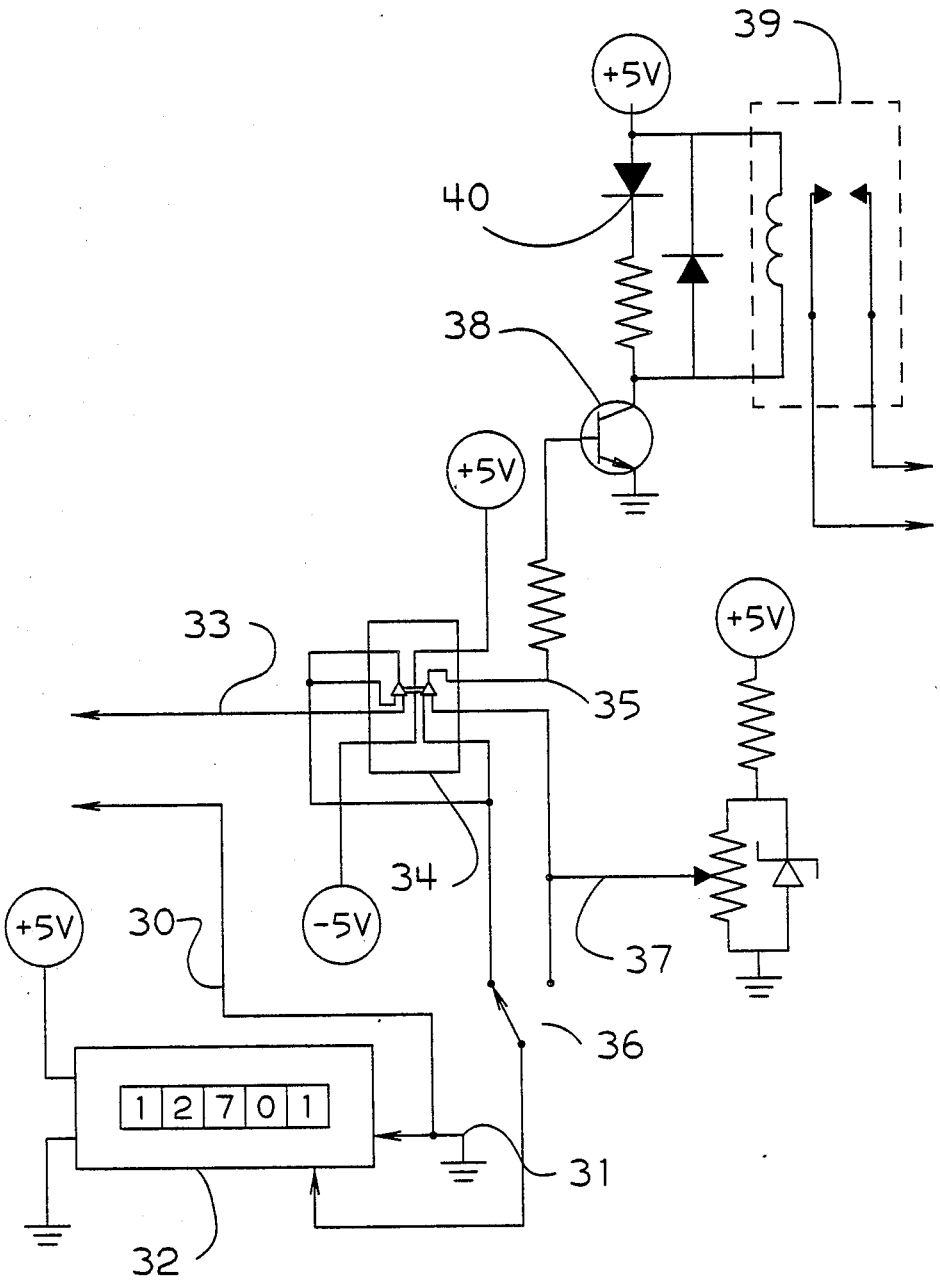
FIG. 3 shows a second embodiment of the invention that is based upon voltage level detection.

FIG. 3 shows a second voltage level sensing embodiment of the invention. In this embodiment the article 15 to be plated is connected to conductor 30 and then to ground potential at 31.

Standard reference electrode 13 is connected to conductor 33, and then to the input of a combined high impedance buffer amplifier and potential level detector in the form of a type 353 JFET dual operational amplifier 34.

A DC digital voltmeter 32 is connected to the output of amplifier 34. The output of this voltmeter allows the curve of FIG. 2 to be dynamically observed during plating. Switch 36, when held in the alternate position from that shown in FIG. 3, allows reference voltage source 37 to be set to a desired DC voltage level, as the magnitude of this voltage is observed on meter 32.

Output conductor 35 from amplifier 34 is connected to transistor 38, which transistor in turn energizes DC relay 39 when the transistor is conductive. Relay 39, when energized, operates to start timer 20. This timer operates to terminate the plating operation after a predetermined plating time interval has expired.

Light emitting diode 40 visually indicates to an operator that relay 39 is energized, and that the plating interval has begun.

The foregoing two embodiments disclose versions of the invention utilizing voltage level detectors. Other specific circuit embodiments will be apparent to those of skill in the art, and the scope of the invention is not to be limited to the specific embodiments above described.

Figure 4:
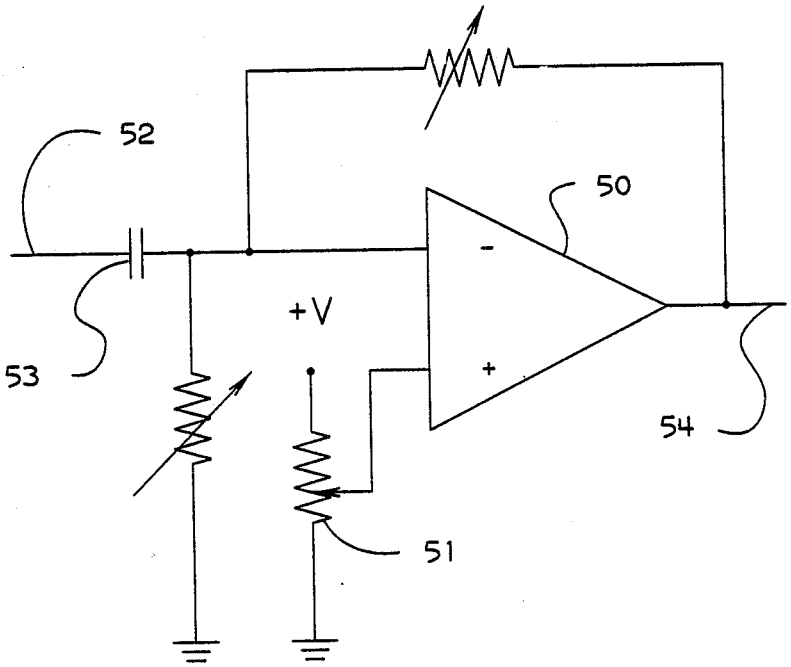
FIG. 4 shows an embodiment of the invention that is based upon rate of change or slope detection.

Another embodiment of the invention uses a transition, rate of change, or slope detector as shown in FIG. 4. In this embodiment, one input of an amplifier 50 receives a fixed magnitude DC reference voltage from potentiometer 51. This reference voltage corresponds in its operation to reference source 18 of FIG. 1. A conductor 52 receives the mixed potential voltage from the plating bath, for example the output of high impedance amplifier 17 of FIG. 1. Capacitor 53 operates to pass only rapid changes in the mixed potential waveform, such as jump 25 of FIG. 2, to the second input of amplifier 50. In this way, output 54 of amplifier 50 operates to start a timer, such as timer 20 of FIG. 1, only when the mixed potential curve experiences a sudden transition whose magnitude generates a voltage which is high enough, in comparison to the magnitude of source 51, to indicate that plating has begun.

While the present invention has been described with reference to preferred embodiments, other embodiments of the invention will be apparent to those of skill in the art. Therefore, the scope and spirit present invention is not to be limited by the forgoing description of preferred embodiments of the invention.

We claim as our invention:

1. A system for repeatedly controlling the thickness of an electroless plated metal layer including detecting the onset of plating in an electroless plating process and subsequently terminating the plating process at a predetermined time after onset of plating has been detected, comprising, providing an electroless plating bath controlled to provide a uniform deposition rate, placing a standard reference electrode in said bath, placing a surface to be plated in said bath, measuring the mixed potential between said reference electrode and said surface, detecting a predetermined mixed potential level that indicates the initiation of plating, timing a predetermined plating interval, beginning with the detection of said predetermined mixed potential level, and terminating the plating process after a predetermined interval has been measured.

2. The method of claim 1 wherein said measuring step comprises sensing a magnitude of said mixed potential.

3. The method of claim 1 wherein said measuring step comprises sensing a sudden change in the magnitude of said mixed potential.

4. The method of claim 1 wherein said surface of a magnetic recording disk to be coated to a thickness not exceeding 2000 angstroms, and wherein said plating bath is a cobalt alloy bath.

5. The method of claim 4 wherein said standard reference electrode is selected from the group silver/silver chloride and calomel.

6. An electroless plating process, comprising, an electroless plating bath which is controlled to provide a uniform deposition rate and has a standard reference electrode immersed therein, an article having a surface to be plated, said surface being immersed in said bath, means electrically connecting said surface of the article and said standard reference electrode in series, through said bath, to a first input of mixed potential level sensing circuit means, a source of reference potential connected to a second input of said sensing circuit means, timing means connected to an output of said sensing circuit means, said timing means being actuated to time said plating process upon the occurrence of a predetermined comparison of said mixed potential to said reference potential, and means operable, upon said timer means timing to a predetermined plating interval, to terminate said plating process.

7. The process of claim 6 wherein said standard reference electrode is selected from the group silver/silver chloride and calomel.

8. The process of claim 7 wherein said timing means is actuated upon the potential level of the mixed potential generated at said reference electrode and said surface reaching a predetermined level.

9. The process of claim 7 wherein said timing means is actuated upon the potential of the mixed potential generated at said reference electrode and said surface reaching a predetermined rate of change.

10. The process of claim 7 wherein said article is a magnetic recording disk, wherein said plating bath is a cobalt alloy bath, and wherein said process is terminated after a thin cobalt alloy recording layer, not exceeding a thickness of 2000 angstroms, has been plated on said disk.

* * * * *